US006854362B1

(12) United States Patent
Huang

(10) Patent No.: US 6,854,362 B1
(45) Date of Patent: Feb. 15, 2005

(54) ONE-WAY WRENCH

(75) Inventor: Hsiu-Ching Huang, Taipei (TW)

(73) Assignee: Terence Chen, Yi Lan Hsien (TW)

( * ) Notice: Subject to any disclaimer, the term of this patent is extended or adjusted under 35 U.S.C. 154(b) by 0 days.

(21) Appl. No.: 10/681,111

(22) Filed: Oct. 9, 2003

(30) Foreign Application Priority Data

Aug. 29, 2003 (TW) ..... 92124028 A

(51) Int. Cl.[7] ..... B25B 13/46
(52) U.S. Cl. ..... 81/60
(58) Field of Search ..... 81/58, 60, 61, 81/62, 63, 63.1, 63.2

(56) References Cited

U.S. PATENT DOCUMENTS 6,134,990 A * 10/2000 Ling et al. ..... 81/60
6,446,530 B1 * 9/2002 Chang ..... 81/60

* cited by examiner

*Primary Examiner*—Jacob K. Ackun, Jr.
(74) *Attorney, Agent, or Firm*—Birch, Stewart, Kolasch & Birch, LLP

(57) ABSTRACT

A one-way wrench includes a head, biasing means, a pawl and a gear. The head defines a circular space, a crescent space communicated with the circular space and a hole communicated with the crescent space. The biasing means includes a first spring and a weaker and longer second spring. The springs both include a first end put in the hole and a second end put in the crescent space. The pawl is movably put in the crescent space and includes an end abutted against the second end of the second spring and a toothed side. The gear is rotationally put in the circular space and includes a toothed periphery for engagement with the toothed side of the pawl.

20 Claims, 11 Drawing Sheets

ONE-WAY WRENCH

This Nonprovisional application claims priority under 35 U.S.C. §119 (a) patent application No(s). 092124028 filed in Taiwan on Aug. 29, 2003, the entire contents of which are hereby incorporated by reference.

FIELD OF INVENTION

The present invention relates to a one-way wrench.

BACKGROUND OF INVENTION

Referring to FIG. 11, a conventional one-way wrench 80 includes a head 81 defining a circular space 82, a crescent space 83 communicated with the circular space 82 and a hole 86 communicated with the crescent space 83, an annular gear 84 rotationally put in the circular space 82, a pawl 85 movably put in the crescent space 83 for releasable engagement with the annular gear 84 and a spring 87 including an end put in the hole 86 and an opposite end connected with the pawl 85. The spring 87 is compressed between a wall of the crescent space 83 and the pawl 85 for biasing the pawl 85 into engagement with the annular gear 84. The spring 87 is essential for adequate operation of the pawl 85 and hence the entire one-way wrench 80. However, the spring 87 is vulnerable to excessive deformation. Therefore, adequate operation of the one-way wrench 80 could be jeopardized.

The present invention is therefore intended to obviate or at least alleviate the problems encountered in prior art.

SUMMARY OF INVENTION

It is the primary objective of the present invention to provide a one-way wrench that ensures adequate operation.

According to the present invention, a one-way wrench includes a head, biasing means, a pawl and a gear. The head defines a circular space, a crescent space communicated with the circular space and a hole communicated with the crescent space. The biasing means includes a first spring and a weaker and longer second spring. The springs both include a first end put in the hole and a second end put in the crescent space. The pawl is movably put in the crescent space and includes an end abutted against the second end of the second spring and a toothed side. The gear is rotationally put in the circular space and includes a toothed periphery for engagement with the toothed side of the pawl.

Other objects, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
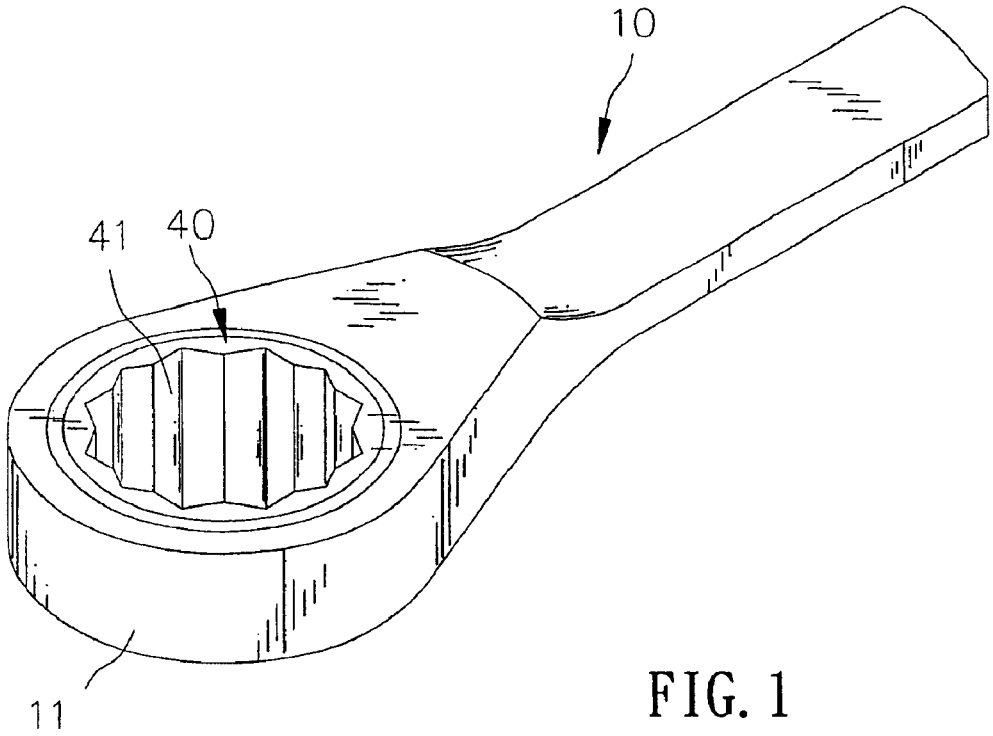
FIG. 1 is a perspective view of a one-way wrench according to a first embodiment of the present invention.
Figure 2:
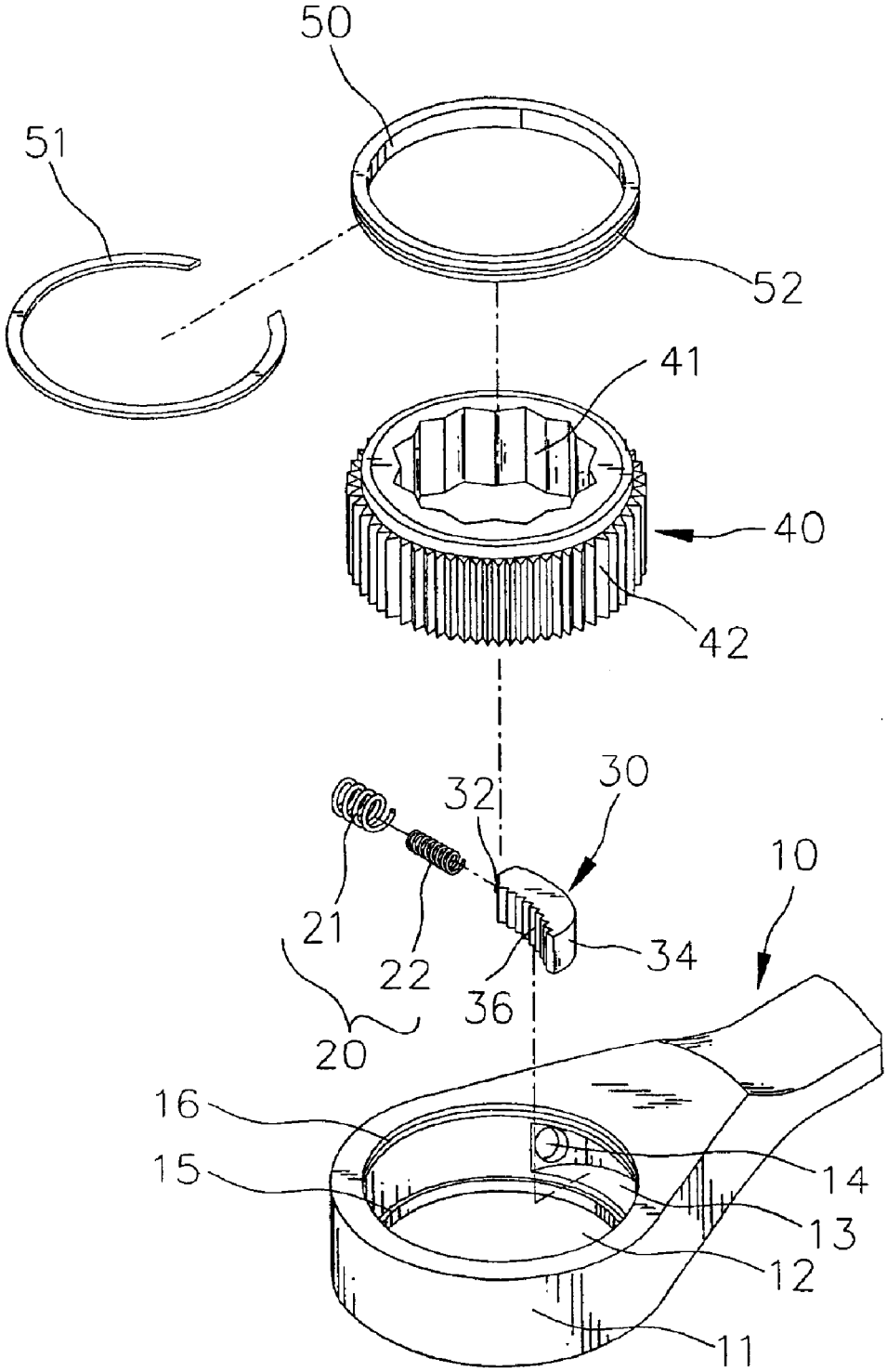
FIG. 2 is an exploded view of the one-way wrench of FIG. 1.

Referring to FIGS. 1 and 2, according to a first embodiment of the present invention, a one-way wrench 10 includes a head 11, a handle (not numbered) extending from the head 11, an annular gear 40, a pawl 30, biasing means 20, an O-ring 50 and a C-ring 51.

The head 11 defines a circular space 12, a crescent space 13 communicated with the circular space 12 and a hole 14 communicated with the crescent space 13. An annular edge 15 is formed on a wall of the circular space 12. A groove 16 is defined in the wall of the circular space 12.

The biasing means 20 includes a first spring 21 and a second spring 22 put in the first spring 21. The springs 21 and 22 both include a first end put in the hole 14 and a second end put in the crescent space 13. The first spring 21 is stronger and shorter than the second spring 22.

The pawl 30 is movably put in the crescent space 13. The pawl 30 includes a stud 32 formed on an end thereof, a smooth side 34 and a toothed side 36. The stud 32 is put in the second spring 22.

The annular gear 40 is rotationally put in the circular space 12. The annular gear 40 is supported on the annular edge 15. The annular gear 40 includes a toothed external side 42 for engagement with the toothed side 36 of the pawl 30 and a toothed internal side 41 for engagement with a fastener (not shown).

The O-ring 50 is put in the circular space 12 and supported on the annular gear 40. The O-ring 50 includes a groove 52 defined in an external side thereof.

The C-ring 51 includes an internal edge put in the groove 52 of the O-ring 50 and an external edge put in the groove 16 of the head 11 so as to hold the O-ring 5 to the head 11. Thus, the annular gear 40, the pawl 30 and the biasing means 20 are held to the head 11.

The biasing means 20, the second spring 22 to be specific, is compressed between a wall of the crescent space 13 and the pawl 30 for biasing the pawl 30 against the annular gear 40. Thus, the toothed side 36 of the pawl 30 is brought into engagement with the toothed external side 42 of the annular gear 40.

Figure 3:
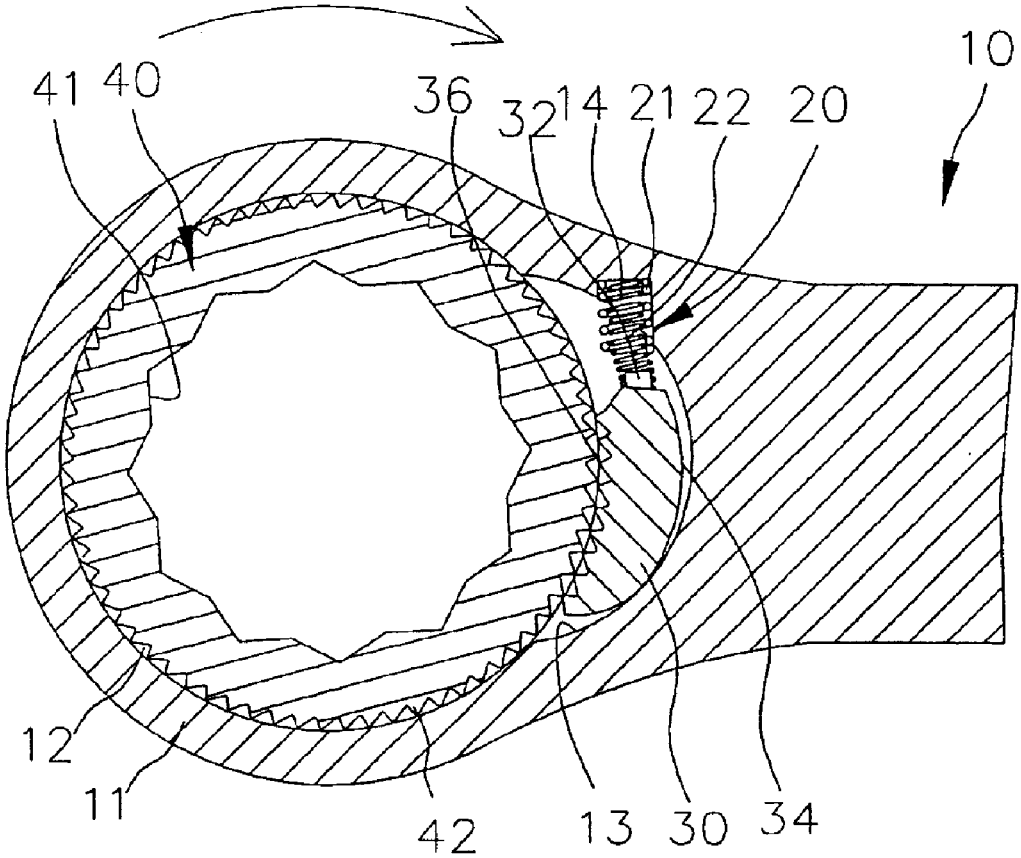
FIGS. 3–5 are cross-sectional views of the one-way wrench of FIG. 1 and show the one-way wrench ready for driving a fastener in a direction and not in an opposite direction.

Referring to FIG. 3, the head 11 is rotated clockwise relative to a fastener. (not shown) engaged with the annular gear 40. The fastener holds the annular gear 40 in position. The annular gear 40 holds the pawl 30 in position. As a result, the second spring 22 is further compressed so as to allow disengagement of the pawl 30 from the annular gear 40. Thus, the fastener remains un-rotated.

Figure 4:
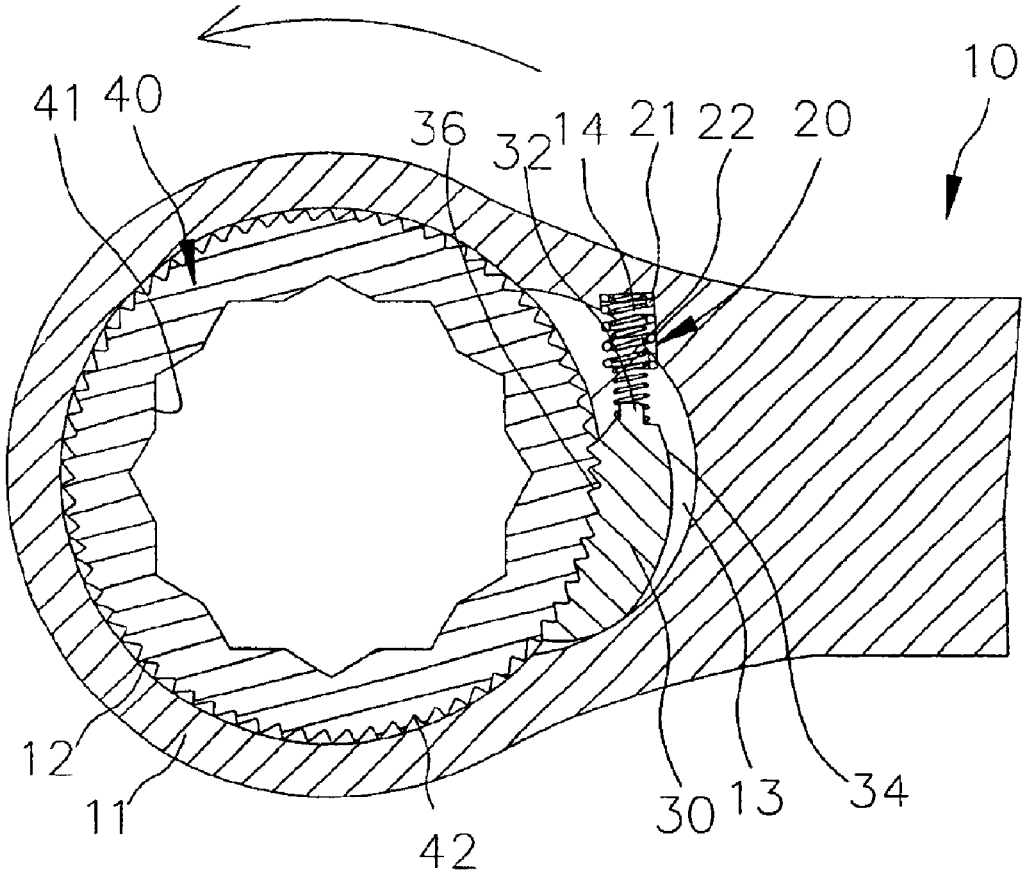

Referring to FIG. 4, the head 11 is rotated counterclockwise relative to the fastener. The wall of the crescent space 13 pushes the pawl 30 by the smooth side 34. The pawl 30 rotates the annular gear 40. The annular gear 40 rotates the fastener.

Figure 5:
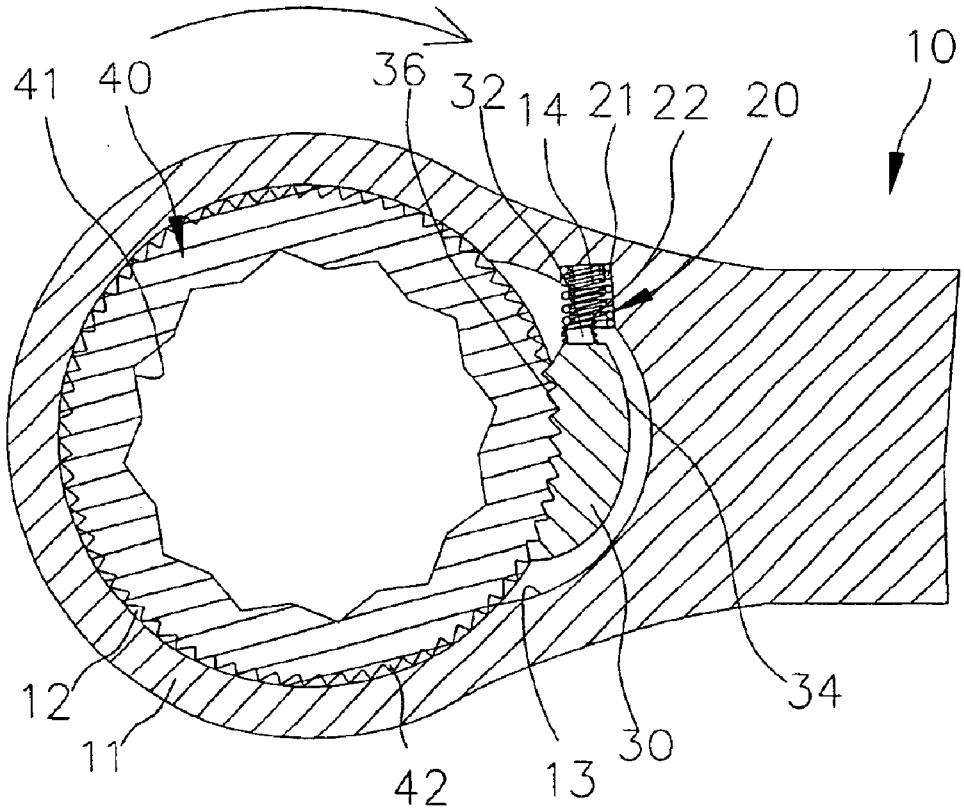

Referring to FIG. 5, if the toothed side 36 of the pawl 30 accidentally sticks to the toothed external side 42 of the annular gear, the head 11 rotates the fastener clockwise. The second spring 22 is further compressed. The second spring 22 is protected from excessive deformation by means of the first spring 21. Then, the first spring 21 is compressed. The springs 21 and work together so as to forcefully disengage the pawl 30 from the annular gear 40. After that, the head 11 no longer rotates the fastener clockwise.

Figure 6:
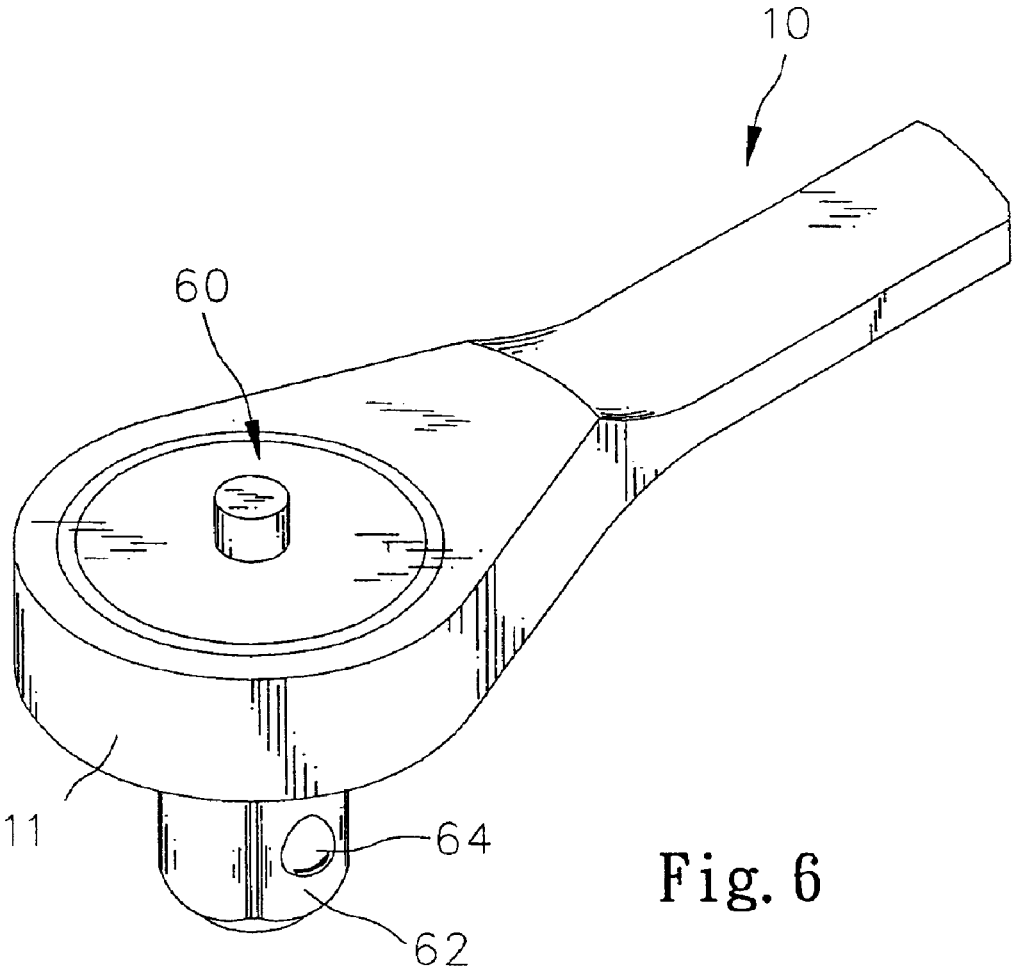
FIG. 6 is a perspective view of a one-way wrench according to a second embodiment of the present invention.
Figure 7:
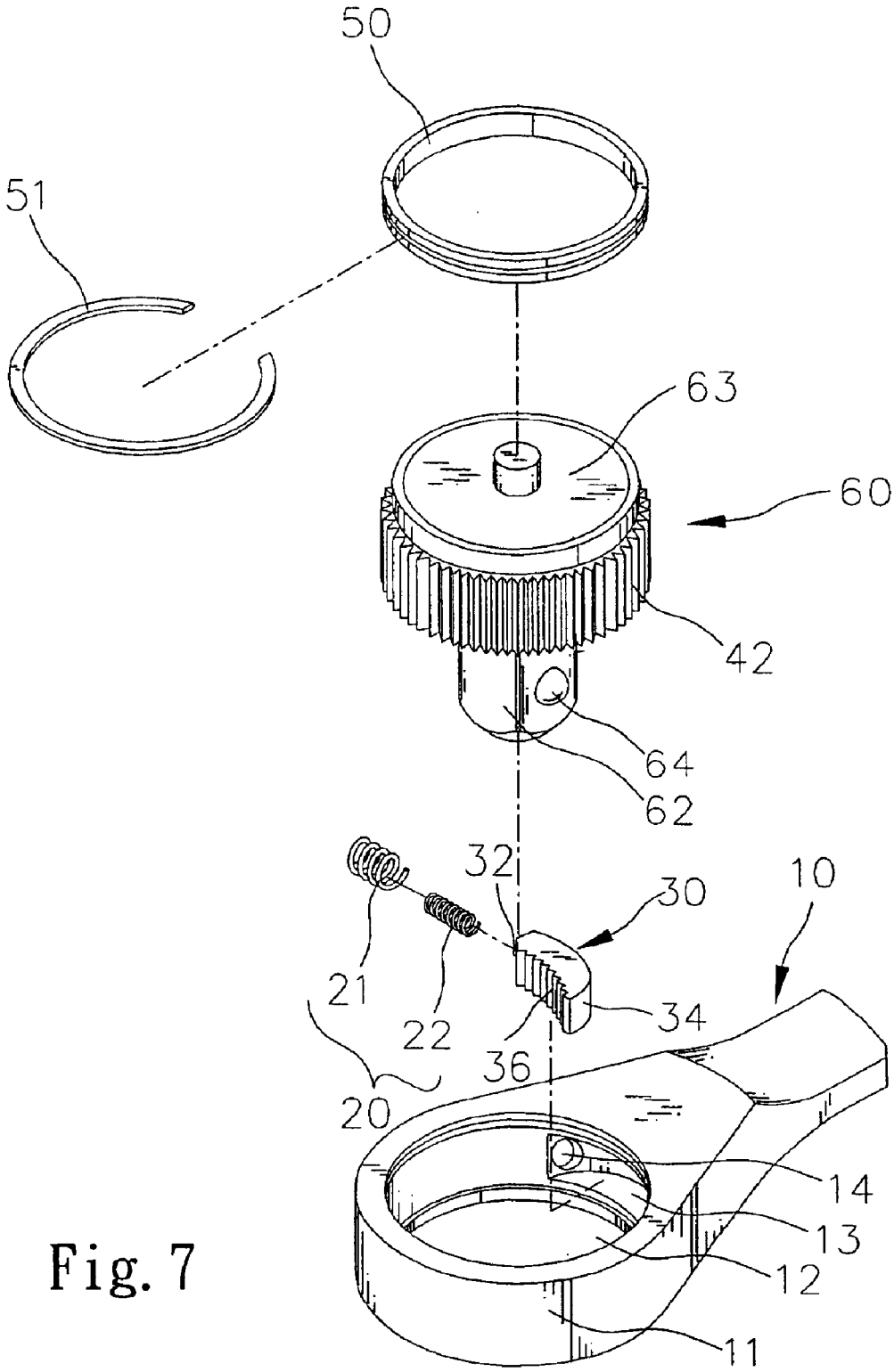
FIG. 7 is an exploded view of the one-way wrench of FIG. 6.

FIGS. 6 and 7 show a one-way wrench according to a second embodiment of the present invention. The second embodiment is identical to the first embodiment except for including a gear 60 instead of the annular gear 40. The gear 60 includes a cylinder 62 for insertion into a socket (not shown). A detent 64 is attached to the cylinder 62 for contact with an internal wall of the socket. A quick-release device 63 is installed at the cylinder 62 in order to control the detent 64.

Figure 9:
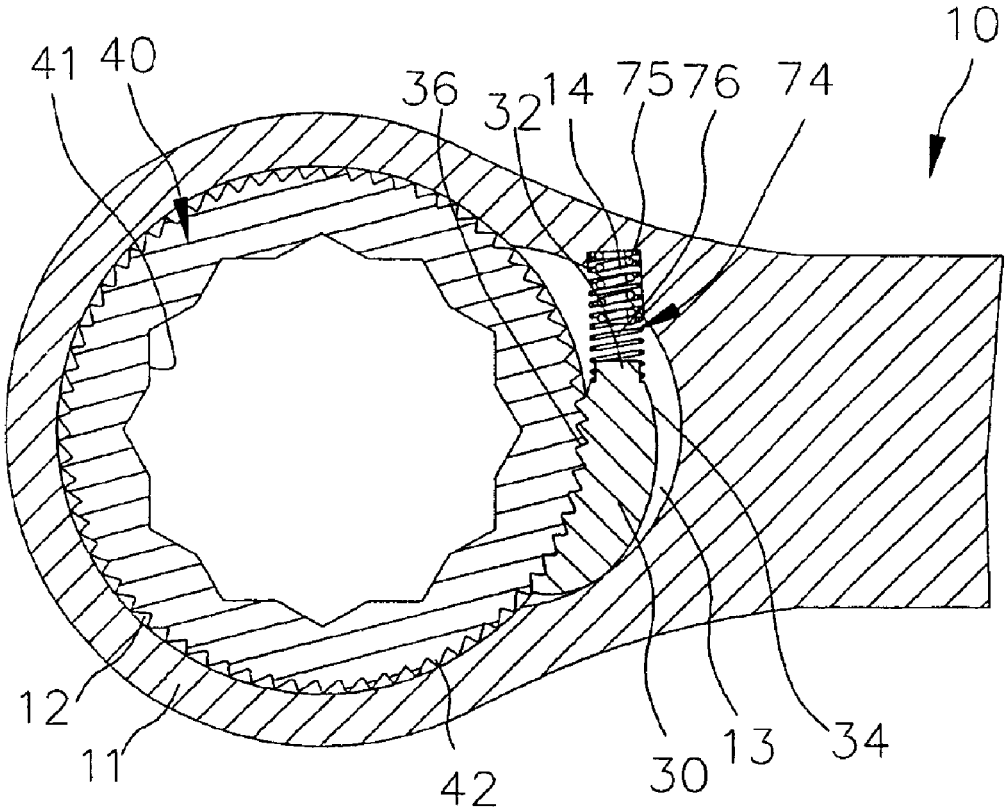
FIG. 9 is a cross-sectional view of a third type of biasing means used in the one-way wrench according to the present invention.

FIG. 9 shows another type of biasing means 74. The biasing means 74 includes a first spring 75 and a second spring 76 in which the first spring 75 is put. The springs 75 and 76 both include an end put in the hole 14 and a second end put in the crescent space 13. The first spring 75 is stronger and shorter than the second spring 76. The second spring 76 is protected from excessive deformation by means of the first spring 75.

Figure 8:
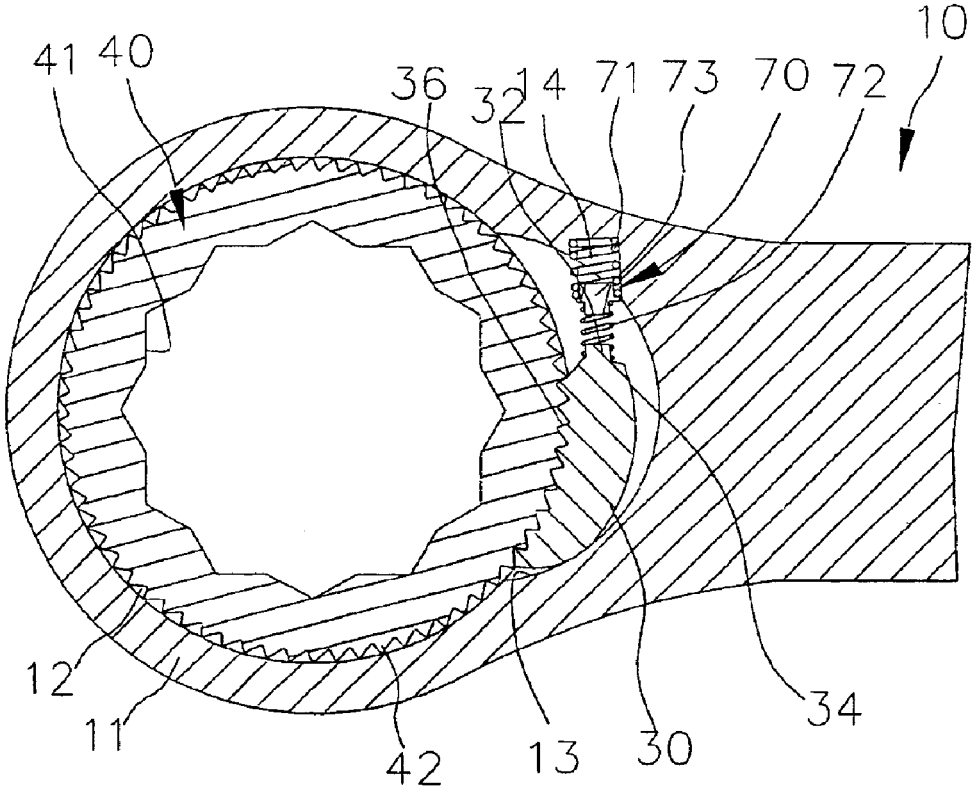
FIG. 8 is a cross-sectional view of a second type of biasing means used in the one-way wrench according to the present invention.

Referring to FIG. 8, another type of biasing means 70 is shown. The biasing means 70 includes a first spring 71, a second spring 72 and a joint 73 connecting the firs spring 71 with the second spring 72. The first spring 71 includes a first end put in the hole 14 and a second end put in the crescent space 13. The second spring 72 includes a first end and a second end in which the stud 32 is put. The joint 73 includes a first end put in the second end of the first spring 71 and a second end put in the first end of the second spring 72. The first spring 71 is stronger than the second spring 72. As being shorter, the second spring 72 is less vulnerable to excessive deformation than the spring 87 of the one-way wrench 80 discussed in the Summary of Invention. As being stronger than the second spring 72, the first spring 71 is even less vulnerable to excessive deformation than the spring 87 of the conventional one-way wrench 80 discussed in the Summary of Invention.

Figure 10:
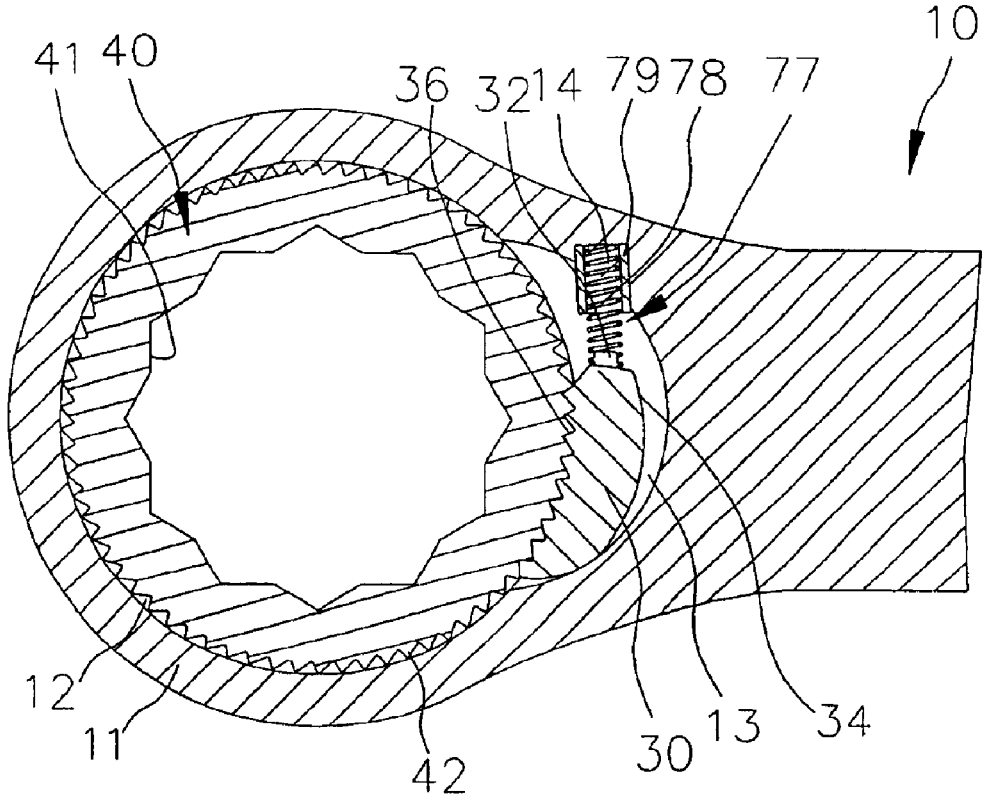
FIG. 10 is a cross-sectional view of a fourth type of biasing means used in the one-way wrench according to the present invention.
Figure 11:
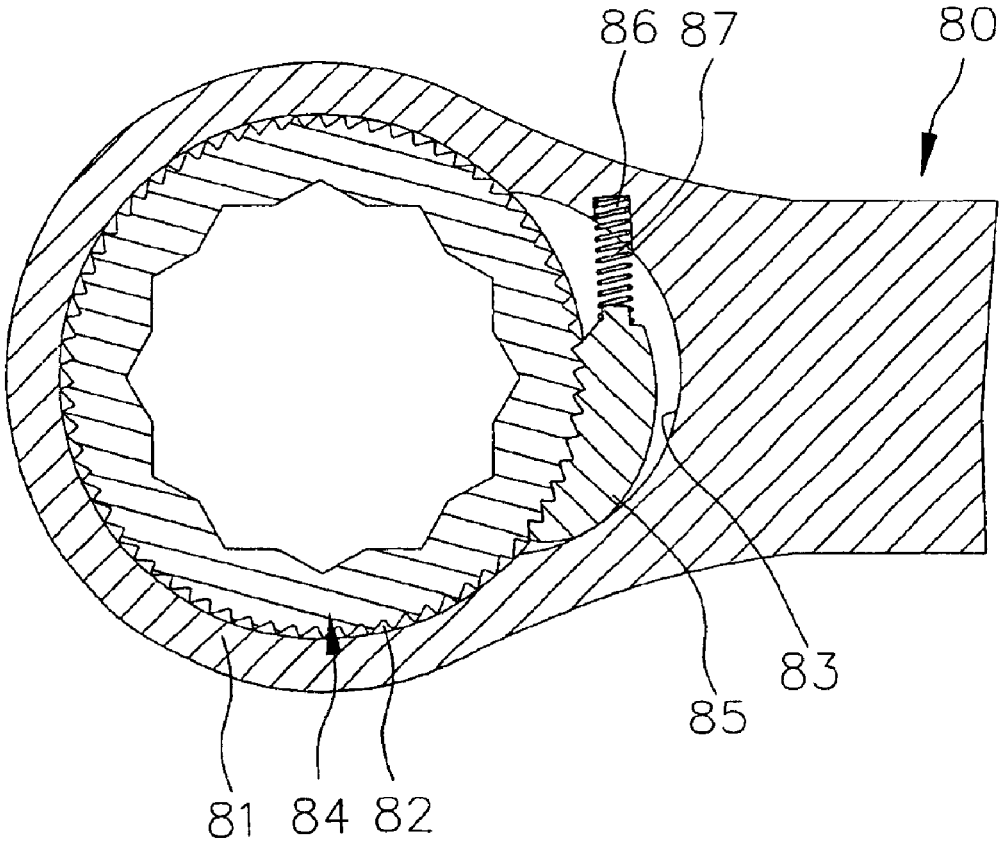
Fig. 11 PRIOR ART
FIG. 11 is a cross-sectional view of a conventional one-way wrench.

Referring to FIG. 10, another type of biasing means 77 is shown. The biasing means 70 includes a spring 78 and a sleeve 79 in which the spring 78 is put. The spring 78 and the sleeve 79 both include an end put in the hole 14 and a second end put in the crescent space 13. The stub 32 is put in the second end of the spring 78. The spring 78 is protected from excessive deformation by means of the sleeve 79.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A one-way wrench including:

a head defining a circular space, a crescent space communicated with the circular space and a hole communicated with the crescent space;

biasing means including a first spring and a weaker and longer second spring, wherein the springs both include a first end put in the hole and a second end put in the crescent space;

a pawl being movably put in the crescent space and including an end abutted against the second end of the second spring and a toothed side; and a gear being rotationally put in the circular space and including a toothed periphery for engagement with the toothed side of the pawl.

2. The one-way wrench according to claim 1, wherein the springs are arranged in a co-axial manner.

3. The one-way wrench according to claim 2, wherein the second spring is put in the first spring.

4. The one-way wrench according to claim 2, wherein the first spring is put in the second spring.

5. The one-way wrench according to claim 1, wherein the pawl includes a stud formed on the end and put in the second end of the second spring.

6. The one-way wrench according to claim 1, wherein the head includes an annular edge formed on a wall of the circular space, and the gear is supported on the annular edge.

7. The one-way wrench according to claim 1 further including a C-ring including an internal edge for abutting the gear and an external edge, wherein the head includes a groove defined in a wall of the circular space in order to receive the external edge of the C-ring.

8. The one-way wrench according to claim 7 further including an O-ring including an internal edge for abutting the gear and an external edge defining a groove for receiving the internal edge of the C-ring.

9. The one-way wrench according to claim 1, wherein the gear is an annular gear defining a central space for receiving a fastener.

10. The one-way wrench according to claim 1, wherein the gear includes an axial cylinder extending from a side thereof for insertion into a socket.

11. A one-way wrench including:

a head defining a circular space, a crescent sp ace communicated with the circular space and a hole communicated with the crescent space;

biasing means including a first spring and a weaker second spring, wherein the first spring includes a first end put in the hole and a second end, and the second spring includes a first end connected with the second end of the first spring and a second end put in the crescent space;

a pawl being movably put in the crescent space and including an end abutted against the second end of the second spring and a toothed side; and a gear being rotationally put in the circular space and including a toothed periphery for engagement with the toothed side of the pawl.

12. The one-way wrench according to claim 11 further including a joint with a first end connected with the second end of the first spring and a second end connected with the first end of the second spring.

13. The one-way wrench according to claim 12, wherein the first end of the joint is put in the second end of the first spring, and the second end of the joint is put in the first end of the second spring.

14. The one-way wrench according to claim 11, wherein the pawl includes a stud formed on the end and put in the second end of the second spring.

15. The one-way wrench according to claim 11 wherein the gear is an annular gear defining a central space for receiving a fastener.

16. The one-way wrench according to claim 11 wherein the gear includes an axial cylinder extending from a side thereof for insertion into a socket.

17. A one-way wrench including:

a head defining a circular space, a crescent space communicated with the circular space and a hole communicated with the crescent space;

biasing means including a spring and a sleeve in which the spring is put, wherein the spring and the sleeve both include an end put in the hole and a second end put in the crescent space;

a pawl being movably put in the crescent space and including an end abutted against the second end of the spring and a toothed side; and a gear being rotationally put in the circular space and including a toothed periphery for engagement with the toothed side of the pawl.

18. The one-way wrench according to claim 17, wherein the pawl includes a stud formed on the end and put in the second end of the spring.

19. The one-way wrench according to claim 17, wherein the gear is an annular gear defining a central space for receiving a fastener.

20. The one-way wrench according to claim 17, wherein the gear includes an axial cylinder extending from a side thereof for insertion into a socket.

* * * * *